United States Patent [19]

Buchmüller et al.

[11] Patent Number: 4,534,299

[45] Date of Patent: Aug. 13, 1985

[54] WET ASH REMOVAL EQUIPMENT

[75] Inventors: Horst Buchmüller, Hünxe; Bernhard Michelbrink, Wesel-Bislich, both of Fed. Rep. of Germany

[73] Assignee: Deutsche Babcock Werke Aktiengesellschaft, Oberhausen, Fed. Rep. of Germany

[21] Appl. No.: 697,337

[22] Filed: Feb. 1, 1985

[30] Foreign Application Priority Data

Mar. 7, 1984 [DE] Fed. Rep. of Germany ..... 3408279

[51] Int. Cl.[3] ..... F23J 1/00

[52] U.S. Cl. ..... 110/165 R; 110/171

[58] Field of Search ..... 110/165 R, 170, 171; 414/214

[56] References Cited

U.S. PATENT DOCUMENTS

| | | | |
|---|---|---|---|
| 3,915,105 | 10/1975 | Michelbrink | 110/165 R |
| 4,112,856 | 9/1978 | Fuhrman et al. | 110/165 R |
| 4,301,746 | 11/1981 | Pech et al. | 110/171 |
| 4,321,876 | 3/1982 | Mikus et al. | 110/165 R |
| 4,387,651 | 6/1983 | Moore | 110/171 |
| 4,429,640 | 2/1984 | Sullivan | 110/165 R |

*Primary Examiner*—Henry C. Yuen

*Attorney, Agent, or Firm*—Max Fogiel

[57] ABSTRACT

Wet ash removal equipment in which a trough is filled with quenching water. An immersion member attached to the ash funnel is immersed into the quenching water. A side wall of the trough is sealed by a plate. The plate is supported upon a height-adjustable rod linkage and is guided in its movement on the side of the trough arrangements of rollers.

3 Claims, 6 Drawing Figures

WET ASH REMOVAL EQUIPMENT

BACKGROUND OF THE INVENTION

In a known type of wet ash removal equipment, the flap is detachably connected to the trough by bolts. If, for example, such a trough has to be removed from beneath the boiler for repair purposes, then the bolts which hold the flap in position, must be undone after the water level has been lowered. This work of dismantling the equipment and re-assembly requires a considerable amount of time as well as much manual effort on the part of maintenance personnel.

SUMMARY OF THE INVENTION

The object underlying the present invention is to improve the wet ash removal equipment to such an extent that it is possible to perform operations on the equipment in a short period of time without the expenditure of considerable physical effort.

The object of the present invention is achieved by providing a movable trough which is filled with quenching water and is located beneath the ash funnel of a steam boiler. An ash conveyor operates within the trough, and an immersion member is attached to the funnel so that it can project down below the surface level of the water in the trough.

One side wall of the trough is provided with a removable plate that forms a sealed joint. This plate is greater in length, than the length of the immersion member. At the same time, the height of the plate measured from the upper rim of the trough, is greater than the maximum depth of immersion of the immersion member.

The removable plate is supported upon a height-adjustable rod linkage, and its movement is guided by the size of the trough. The rod linkage may be in the form of a plurality of lifting devices arranged at some distance from one another. The seal may be in the form of an inflatable tube seal.

In the case of this wet ash removal equipment, the flap may be easily lowered in a very short time by the actuation of the rod linkage without manual labor. After displacement of the wet ash removal equipment to one side, the ash funnel is easily accessible, or else the wet ash removal equipment is immediately available for repair work to be done on it.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
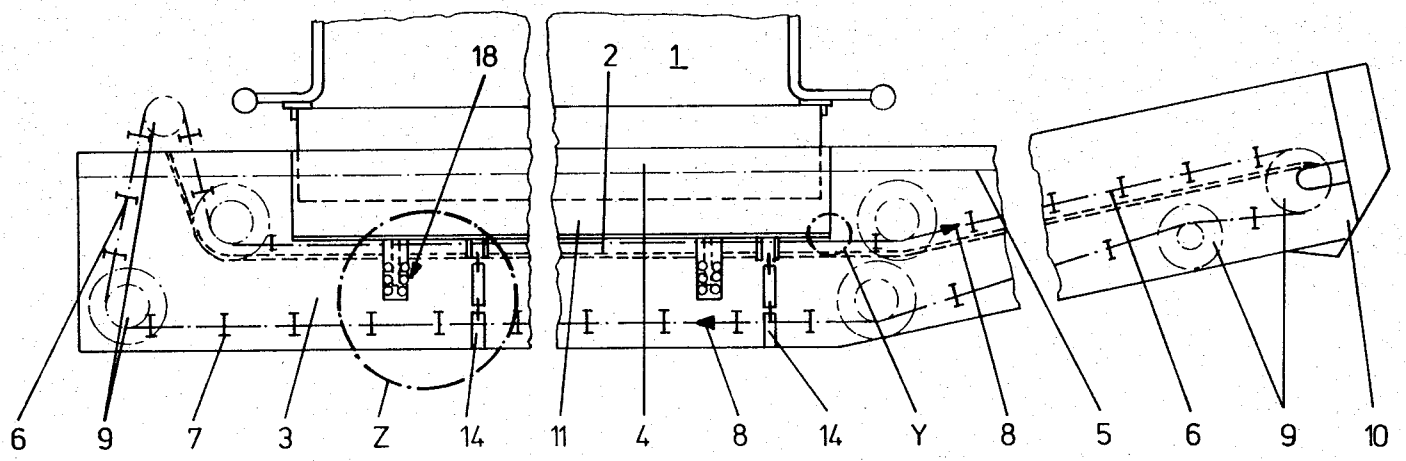
FIG. 1 is a longitudinal section through the wet ash removal equipment, in accordance with the present invention.
Figure 2:
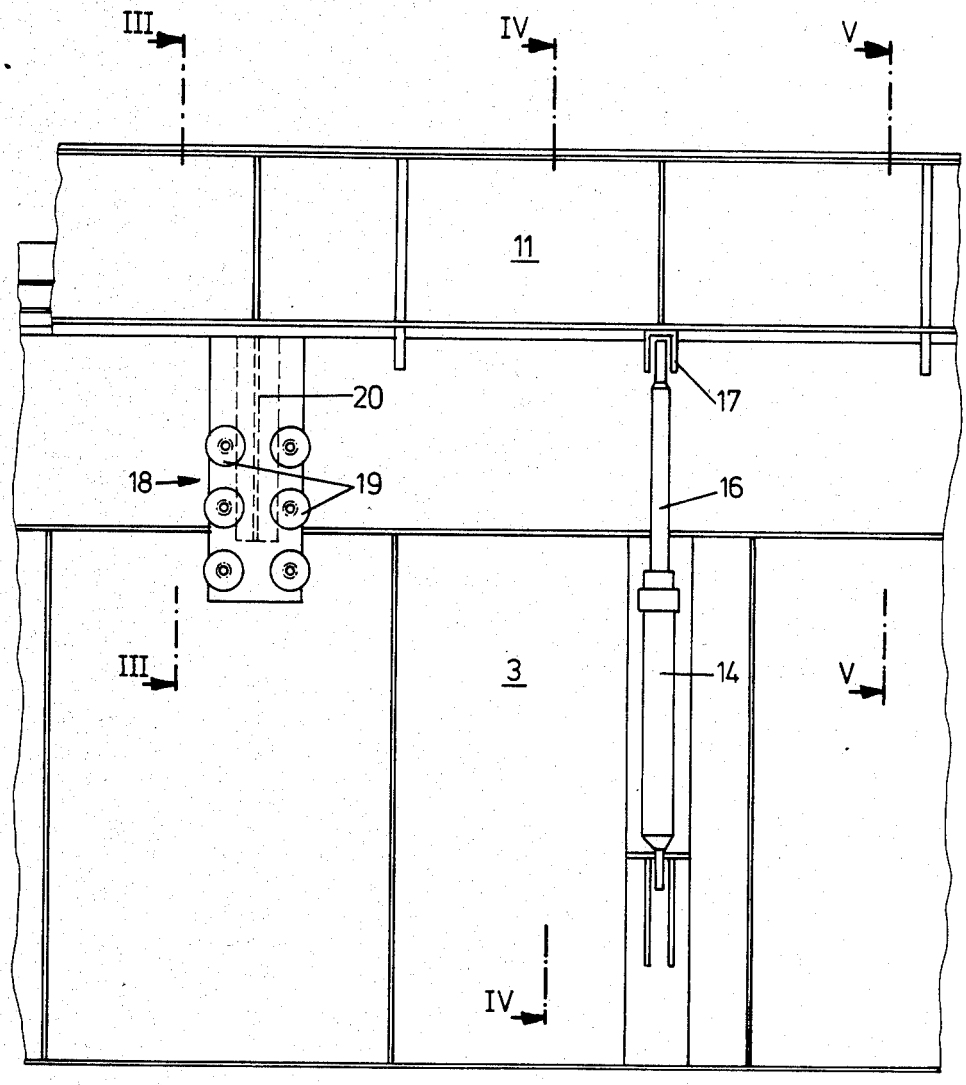
FIG. 2 is a detail view at Z in FIG. 1.

The wet ash removal equipment as depicted finds application in the pulverized coal combustion chambers of steam boiler installations. The ash passes by way of the ash funnel 1 of a boiler, into a trough 3 that is filled with quenching water above an intermediate floor 2. The bottom end of the ash funnel 1 dips down below the water level 5 within the trough 3 by means of an immersion member 4. The ash funnel 1 in this manner is movably sealed in relation to the trough 3. The trough 3 is open at the top and it slopes upwards towards one end. A scraper chain conveyor or a plate belt conveyor moving around in the trough 3 acts as the conveyor device for the removal of the cooled ash. The scraper chain conveyor consists of two chains 6, between which scraper irons 7 are mounted at regular intervals and separate from each other. The chains 6 are guided over rollers 9 in the direction indicated by the arrows 8. The ash which falls down into the wet ash removal equipment is transported along to an ash discharge opening 10 by means of the conveyor where the wet cooled ash is discharged from the system.

A removable flap 11 is provided in the upper section of one side wall of the trough 3. The flap 11 consists of a vertical plate 12 with reinforcing ribs 13 projecting backwards on its outer surface. The length of the flap 11 is greater than the length of the immersion member 4. The height of the flap measured from the upper rim of the trough 3 is greater than the maximum depth of immersion of the immersion member 4. After removal of the flap 11, the trough 3 may be moved out sideways beneath the ash funnel 1 because the side wall of the trough is now open to allow for this movement.

The removal of the flap 11 is effected by means of a height-adjustable rod linkage. This consists of several pneumatically, hydraulically or mechanically actuated lifting devices. According to the drawing, lifting cylinders 14 are employed and these are supported on console brackets 15. These console brackets 15 are attached to the side wall of the trough 3 below the flap 11. There is a piston rod 16 which is displaceable in the lifting cylinder 14, and the head of the said rod 16 engages in a fork 17. This fork 17 is attached to the underside of the lower reinforcing rib 13 of the flap 11.

Figure 5:
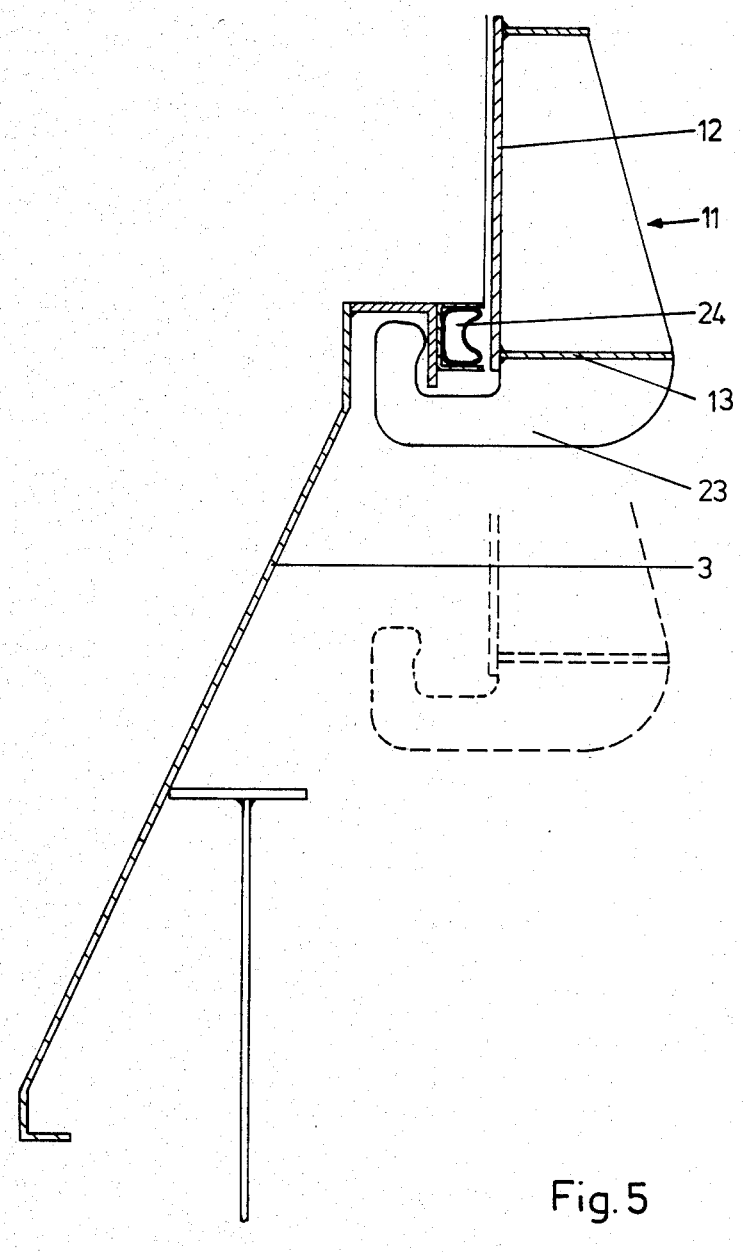
FIG. 5 is a section alone line V—V in FIG. 2.
Figure 6:
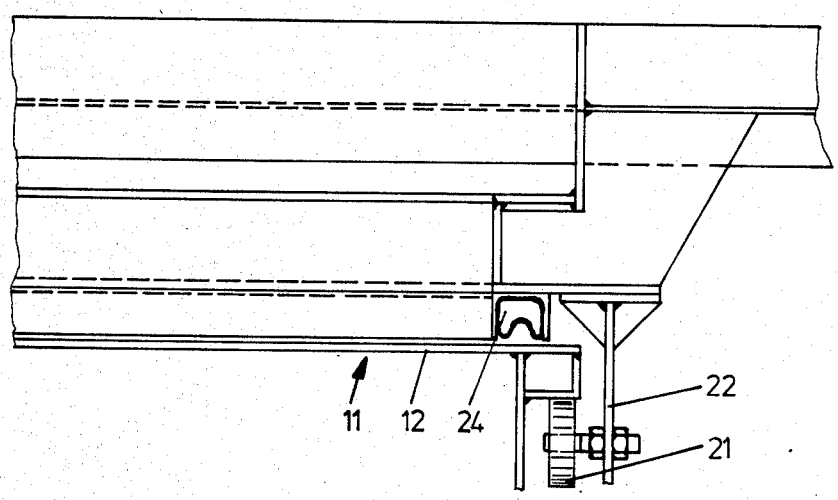
FIG. 6 is a detail view at Y in FIG. 1.

The plate flap 11 is guided along on the side of the trough 3. For this purpose there are arrangements of rollers 18 which are located laterally in relation to the lifting cylinders 14 on the side wall of the trough 3. An arrangement of rollers 18 consists of several pairs of profiled rollers 19 mounted one above the other. The rollers 19 grip around a guide rail 20 which is fastened to the flap 11. Further rollers in the form of pressure rollers 21 are attached to the trough 3 by means of the fastening brackets 22. These pressure rollers 21 exert pressure against the lateral end surfaces of the flap 11. There is a stirrup 23 mounted on the lower reinforcing rib 13 which grips around a web on the trough 3 from beneath as seen in FIG. 5.

For sealing the flap 11 against the side of the trough 3, there is provision of a seal in the form of an inflatable tube seal 24. There is a nipple 25 providing access to the lumen of the tube seal 24 through which a pressure medium may be introduced. The nipple 25 may be connected by way of a reducing valve to a compressed-air reticulation system which may be present. By inflating the tube seal 24 it is forced against the flap 11 to provide sealing against the wall of the trough 3.

Figure 3:
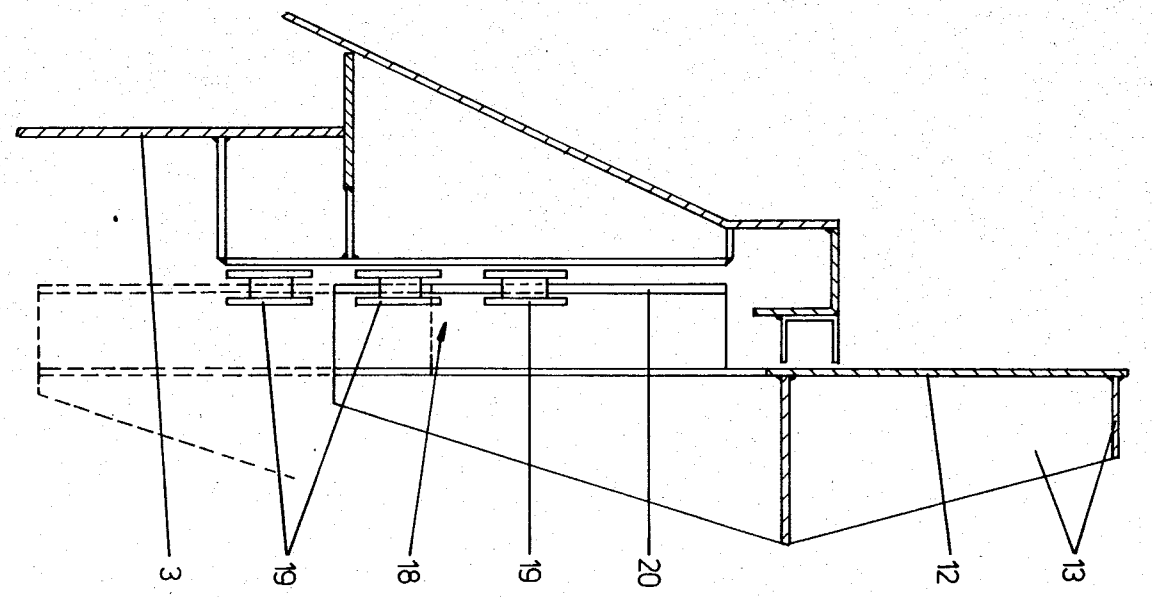
FIG. 3 is a section along line III—III in FIG. 2.
Figure 4:
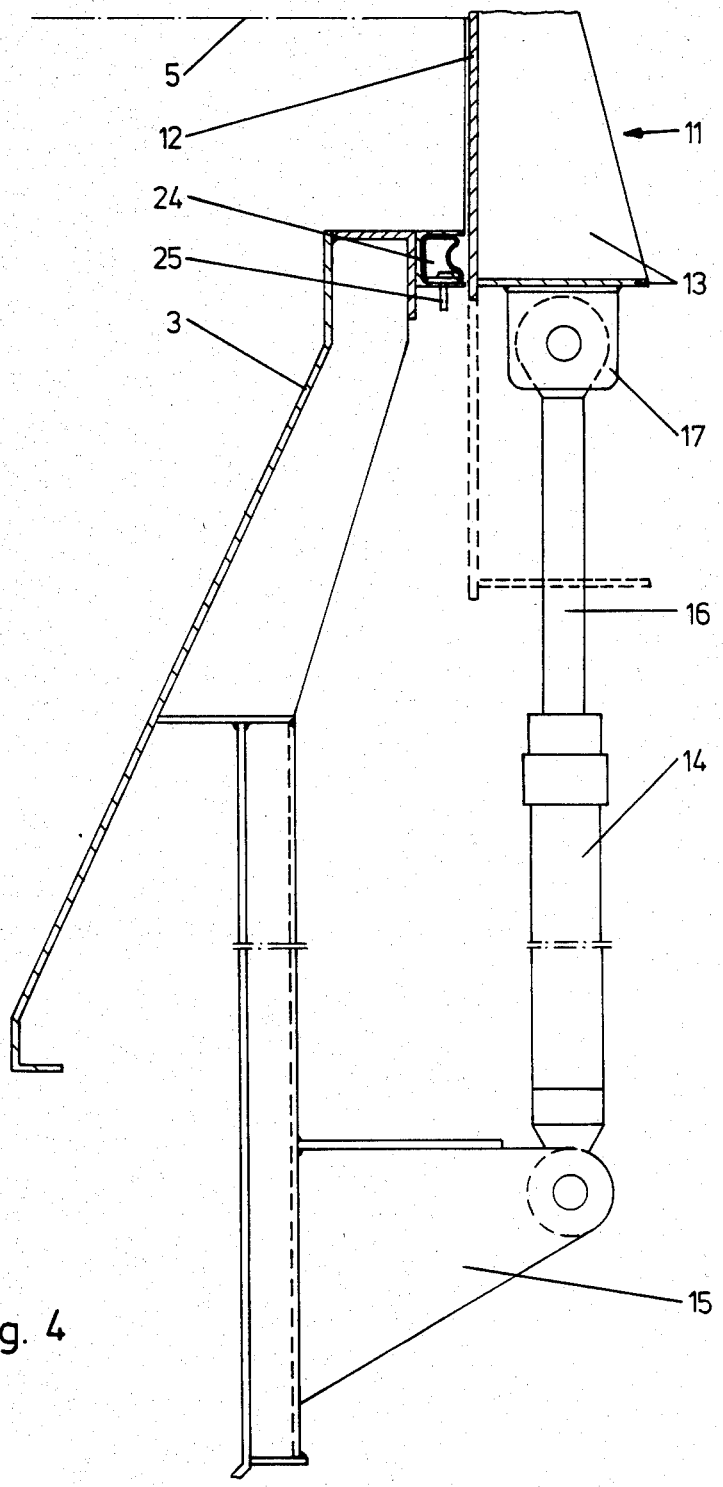
FIG. 4 is a section alone line IV—IV in FIG. 2.

The removal of the flap 11 is effected after lowering the level 5 of the water in the trough 3, and after deflating the seal tube 24, by the lowering of the piston 16 in the lifting cylinder 14. In this way the flap 11 is lowered into the position shown by the broken lines in the FIGS. 3 to 5 inclusive. This position is below the level to which the immersion member 4 can reach down at the maximum below the heated boiler.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. Wet ash removal equipment a steam boiler with an ash funnel; a movable trough filled with quenching water and located beneath said ash funnel of said steam boiler; ash conveyor means operating within the trough; an immersion member attached to said ash funnel so that it can project down below the surface level of the water in said trough; one side wall of said trough having a removable plate forming a sealed joint, said plate having a length which is greater than the length of said immersion member, said plate having a height measured from an upper rim of said trough which is greater than maximum depth of immersion of said immersion member; a height-adjustable rod linkage supporting said plate, movement of said plate being guided by a side of said trough.

2. The wet ash removal equipment according to claim 1, wherein said rod linkage comprises a plurality of lifting devices arranged at predetermined distance from one another.

3. The wet ash removal equipment according to claim 1, wherein said sealed joint comprises further an inflatable tube seal.

* * * * *